US008424440B1

(12) United States Patent
Carson et al.

(10) Patent No.: US 8,424,440 B1
(45) Date of Patent: Apr. 23, 2013

(54) LOW BLAST OVERPRESSURE MUZZLE BRAKE

(75) Inventors: Robert Carson, Watervliet, NY (US); Christopher Aiello, Delmar, NY (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 105 days.

(21) Appl. No.: 13/181,835

(22) Filed: Jul. 13, 2011

(51) Int. Cl.
*F41A 21/34* (2006.01)
*F41A 21/36* (2006.01)

(52) U.S. Cl.
USPC ..... 89/14.3

(58) Field of Classification Search ..... 89/14.2, 89/14.3, 177, 198; 42/1.06
See application file for complete search history.

(56) References Cited

U.S. PATENT DOCUMENTS

| | | | | | |
|---|---|---|---|---|---|
| 817,134 | A * | 4/1906 | Smith | 89/14.3 |
| 1,259,251 | A * | 3/1918 | Love | 181/223 |
| 1,363,058 | A * | 12/1920 | Schneider | 89/14.3 |
| 2,457,802 | A * | 1/1949 | Bauer | 89/14.3 |
| 2,567,826 | A * | 9/1951 | Prache | 89/14.3 |
| 3,714,864 | A * | 2/1973 | Thierry | 89/14.3 |
| 4,242,961 | A * | 1/1981 | Moredock et al. | 102/527 |
| 5,063,827 | A * | 11/1991 | Williamson | 89/14.3 |
| 6,216,578 | B1 * | 4/2001 | Ledys et al. | 89/14.3 |
| 6,578,462 | B1 * | 6/2003 | Franchino et al. | 89/14.3 |
| 7,032,339 | B1 * | 4/2006 | Bounds | 42/1.06 |
| 7,530,299 | B1 * | 5/2009 | Poff | 89/14.3 |
| 8,087,337 | B1 * | 1/2012 | Cary | 89/14.3 |
| 2005/0252365 | A1 * | 11/2005 | Balbo et al. | 89/14.3 |
| 2010/0269387 | A1 * | 10/2010 | Drajan | 42/1.06 |
| 2011/0174141 | A1 * | 7/2011 | Adolphsen | 89/14.3 |

* cited by examiner

*Primary Examiner* — Bret Hayes
(74) *Attorney, Agent, or Firm* — Michael C. Sachs

(57) ABSTRACT

A muzzle brake with reduced blast overpressure may include a body having a top, a bottom, and an attachment hub. Vanes may extend from the top to the bottom. A first vane may be located at a front of the bore in the attachment hub. The first vane may have a forward-angled internal surface. A second vane may be located axially forward of the first vane. The second vane may have a forward-angled rear surface and a forward-angled front surface. A third vane may be located axially forward of the second vane. The third vane may have a rearward-angled rear surface. The forward-angled internal surface of the first vane may include an inner surface adjacent the bore and an outer surface adjacent the inner surface. The inner and outer surfaces may be angled differently with respect to the longitudinal axis.

15 Claims, 4 Drawing Sheets

LOW BLAST OVERPRESSURE MUZZLE BRAKE

STATEMENT OF GOVERNMENT INTEREST

The inventions described herein may be manufactured, used and licensed by or for the U.S. Government for U.S. Government purposes.

BACKGROUND OF THE INVENTION

The invention relates in general to indirect fire weapons and in particular to muzzle brakes for indirect fire weapons.

Muzzle brakes for large caliber indirect fire weapons have been used to reduce recoil energy of the cannon system, thereby allowing the overall weapon system to be reduced in weight. This weight reduction of the system may increase the system transportability by air and land. The M119A2 105 mm howitzer is an example of an indirect fire system that utilizes a muzzle brake for this reason. The M119A2 105 mm howitzer may be transported by a Chinook or UH-60 Black Hawk helicopter. The M119A2 cannon system, known as the M20A1, utilizes a single-baffled brake in its design. The M777 155 mm howitzer system is another system that utilizes a muzzle brake for recoil reduction. The M777 155 mm howitzer system may be transported by MV-22 Osprey, CH-47 helicopter or by truck.

When muzzle brakes are used, propellant gas may be redirected rearward to reduce the recoil energy of the cannon. The incidence of this propellant gas upon the cannon crew may have a direct negative effect on the crew that is manning the cannon. The negative effect of the rearward directed gas is called blast overpressure (BOP). BOP may severely cripple a crew manning a cannon. When the crew is exposed to high BOP levels, they may face several dangers from the blast wave, including significant hearing damage and damage to other body organs. The U.S. Department of Defense uses the MIL-STD-1474D standard to determine if BOP (also known as impulse noise) is too dangerous for the crew, as well as to determine permissible exposure levels per day. Since the inception of muzzle brake technologies, the negative effect of BOP has plagued designers.

In the design of muzzle brakes, it may be desirable to maximize recoil reduction while minimizing the BOP that may be produced. A long-felt and unsolved need exists for a muzzle brake that may generate lower BOP than known muzzle brakes, while still providing adequate recoil reduction.

SUMMARY OF THE INVENTION

It is an object of the invention to provide a muzzle brake that may generate lower BOP than known muzzle brakes, while still providing adequate recoil reduction.

One aspect of the invention is a muzzle brake for attachment to a muzzle of a gun tube. The muzzle brake may include a body having a top, a bottom, and vanes that extend from the top to the bottom. An attachment hub may be located at a rear end of the body. The body and the hub may include a longitudinal bore centered on a longitudinal axis.

A first vane may be being located at a front of the bore in the attachment hub. The first vane may include a forward-angled internal surface. A second vane may be located axially forward of the first vane. The second vane may include a forward-angled rear surface and a forward-angled front surface.

A third vane may be located axially forward of the second vane. The third vane may include a rearward-angled rear surface.

The forward-angled internal surface of the first vane may include an inner surface adjacent the bore and an outer surface adjacent the inner surface. The inner and outer surfaces may be angled differently with respect to the longitudinal axis. The inner surface may have a greater angle with respect to the longitudinal axis than the outer surface.

An outer diameter of the first vane may be greater than outer diameters of the second and third vanes. The outer diameters of the second and the third vanes may be substantially the same.

An internal surface of the top may include a pair of planar surfaces arranged substantially symmetric to a plane that substantially bisects the brake and includes the longitudinal axis. An internal surface of the bottom may include a pair of planar surfaces arranged substantially symmetric to the bisecting plane. The pairs of planar surfaces of the top and bottom may be angled towards each other. Angles formed by the pairs of the planar surfaces with a plane that is normal to the bisecting plane may be substantially equal.

An axial distance from a radially innermost point of the forward-angled internal surface of the first vane to a radially innermost center point of the second vane may be less than an axial distance from the radially innermost center point of the second vane to a radially innermost point of the rearward-angled rear surface of the third vane.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A novel muzzle brake may provide new results by reducing the BOP experienced by the crew of an indirect fire weapon, such as, for example, the M119A2 system. The novel muzzle brake may reduce BOP while maintaining the critical recoil energy reduction. By reducing the BOP, the peak decibel levels may be reduced thereby allowing the crew to fire more rounds in a single day under both single and double ear protection. The ability to fire more rounds may make the indirect fire weapon more lethal to its targets.

The muzzle brake may include a double baffle configuration. The double baffle configuration may allow for the continued recoil reduction of the system. A first baffle may channel the propellant gas blast as the projectile exits. The propellant gas blast pattern produced at the first baffle may interfere with the propellant gas blast pattern produced at the second baffle. The interference may help reduce the BOP: The interference may be achieved by a novel design of the three vanes that define the two baffles.

First and second vanes may define a first baffle. The first vane of the first baffle may not allow the gas to rapidly expand rearward, as in known designs. The top and bottom portions of the first baffle may be contoured specifically to control the gas expulsion. The first and second vanes in the first baffle may have internal surfaces that are angled forward. The forward-angled internal surfaces may direct the expanding high pressure, high temperature gas at an angle of less than 90 degrees, as measured from the direction of travel of the projectile, such that the gasses are propelled down range from the gun and to each side.

The second vane and a third vane may define a second baffle. The third vane may include a rearward-angled internal surface (pressure face) that may maximize recoil reduction from the remaining propellant gases. The first baffle and second baffles may maintain the amount of recoil reduction produced by a known muzzle brake, while reducing the BOP at all crew locations by over 30%.

Figure 1:
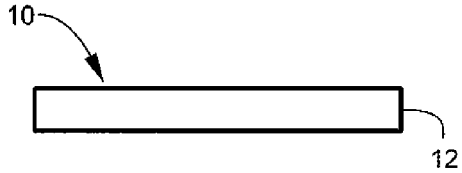
FIG. 1 is a schematic side view of a gun tube.

FIG. 1 is a schematic side view of a gun tube 10 having a muzzle 12. Gun tube 10 may be, for example, a 155 mm Howitzer, a 105 mm Howitzer, or a 120 mm Gun.

Figure 2:
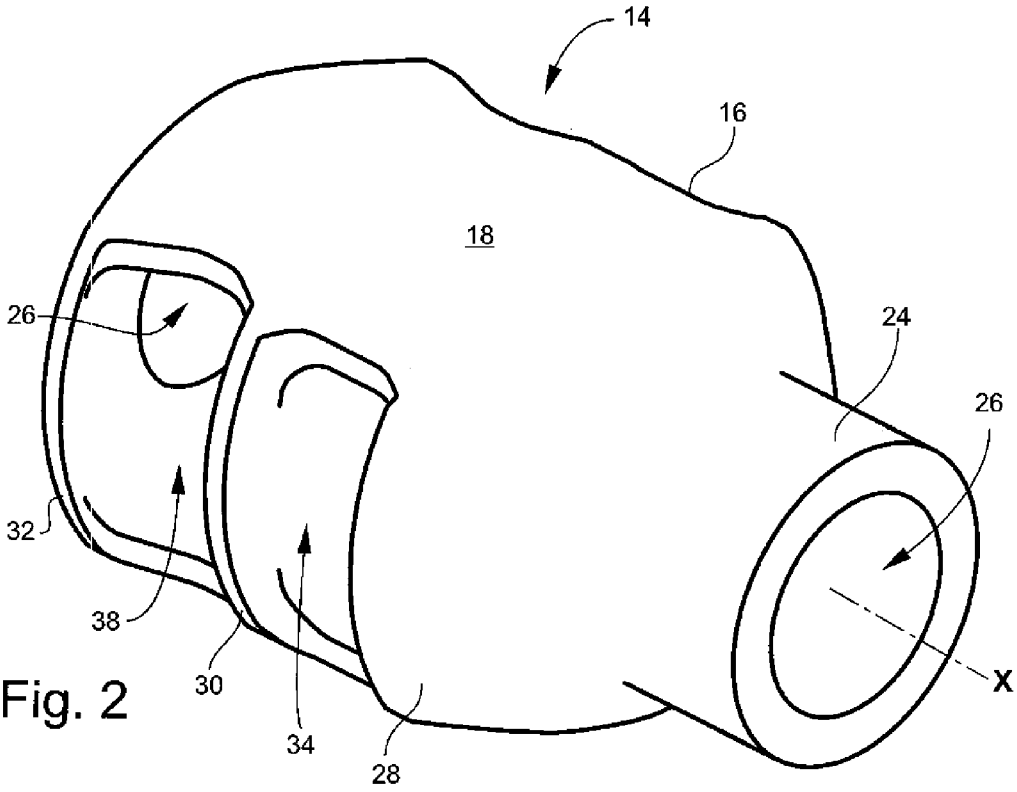
FIG. 2 is a perspective view of an embodiment of a muzzle brake.
Figure 3:
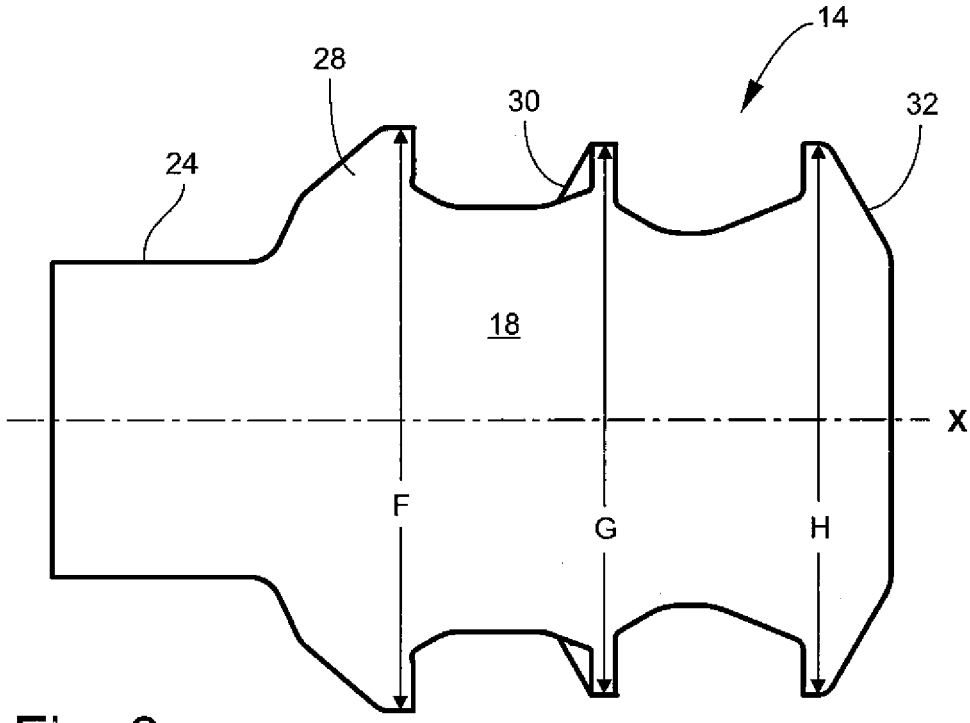
FIG. 3 is a top view of the brake of FIG. 1.
Figure 4:
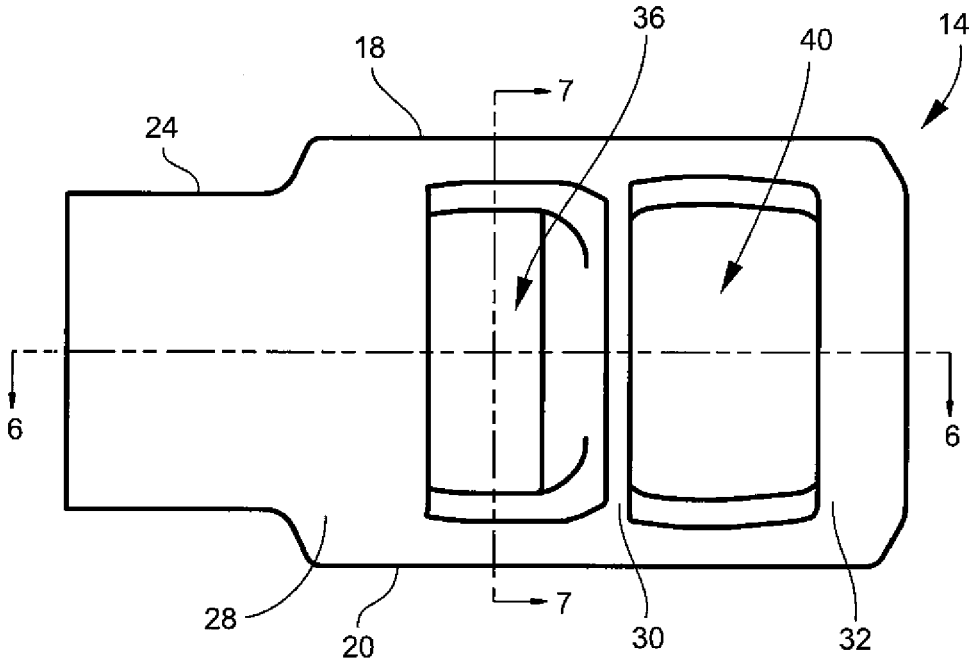
FIG. 4 is a side view of the brake of FIG. 3.
Figure 5:
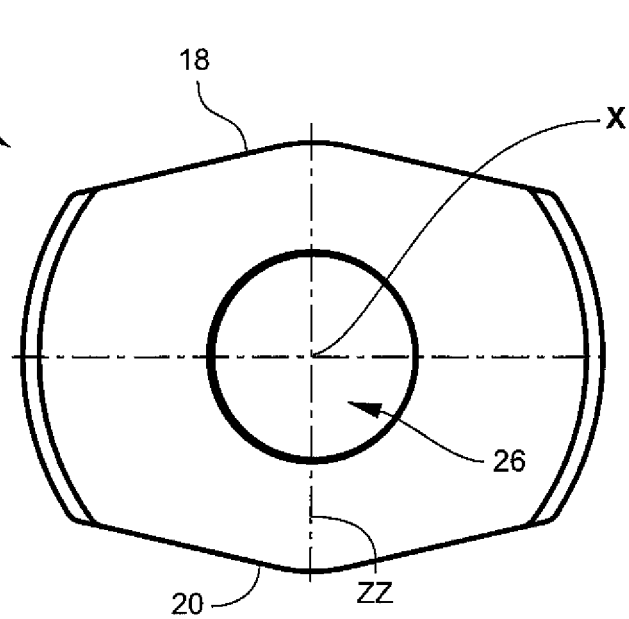
FIG. 5 is an end view of the brake of FIG. 4.

FIG. 2 is a perspective view of an embodiment of a muzzle brake 14 for attachment to muzzle 12 of gun tube 10. FIGS. 3-5 are top, side, and end views, respectively, of muzzle brake 14. Brake 14 may include a body 16 having a top 18, a bottom 20, and an attachment hub 24 at a rear end of body 16. Hub 24 may be fixed to muzzle 12 of gun tube 10 by, for example, internal threads (not shown) in hub 24 that may engage external threads (not shown) on muzzle 12 of gun tube 10. Body 16 and hub 24 may define a longitudinal bore 26 centered on a longitudinal axis X.

Vanes 28, 30, 32 may extend from top 18 to bottom 20. Vanes 28 and 30 may define a first baffle having opposed propellant gas exhaust openings 34 (FIG. 1) and 36 (FIG. 4). Vanes 30 and 32 may define a second baffle having opposed propellant gas exhaust openings 38 (FIG. 1) and 40 (FIG. 4). Three vanes 28, 30, 32 are shown in the Figures, but more than three vanes may be used in some embodiments of the invention.

Figure 6:
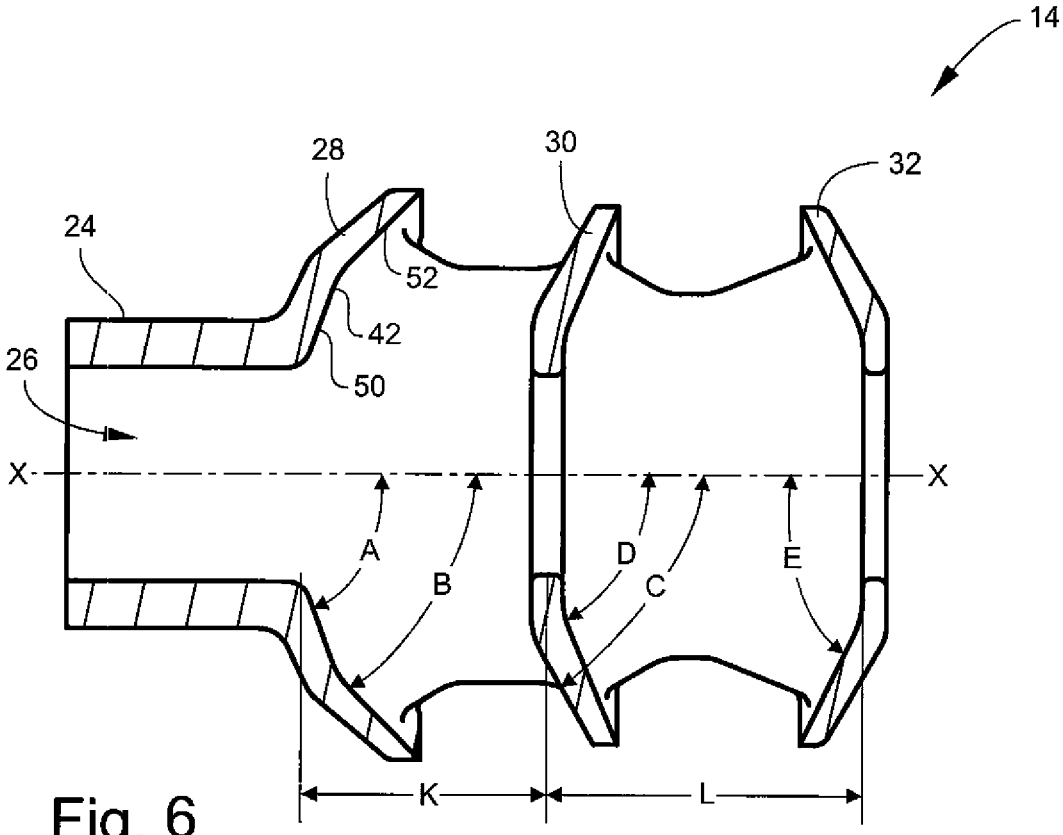
FIG. 6 is a sectional view of the brake taken along the line 6-6 of FIG. 4.

FIG. 6 is a sectional view of brake 14 taken along the line 6-6 of FIG. 4. Vane 28 may be located at a front of bore 26 in attachment hub 24. Vane 28 may have a forward-angled internal surface 42. Vane 30 may be located axially forward of vane 28. Vane 30 may have a rear surface 44 that is angled forward and a front surface 46 that is angled forward. Vane 32 may be located axially forward of vane 30. Vane 32 may have a rear surface 48 that is angled rearward.

Forward-angled internal surface 42 of vane 28 may include an inner surface 50 located adjacent bore 26 and an outer surface 52 located adjacent inner surface 50. Inner and outer surfaces 50, 52 may be angled differently with respect to longitudinal axis X. Inner surface 50 may have a greater angle with respect to longitudinal axis X than outer surface 52 to better control the gas expansion and direction. Inner surface 50 may have an angle A with respect to axis X. Outer surface 52 may have an angle B with respect to axis X. Angle A between inner surface 50 and longitudinal axis X may be in a range of about 65 to about 75 degrees. Angle B between outer surface 52 and longitudinal axis X may be in a range of about 40 to about 45 degrees.

When brake 14 is used with gun tube 10 having a 105 mm caliber, angle A may be about 70 degrees and angle B may be about 45 degrees.

Forward-angled rear surface 44 of vane 30 may have an angle C with respect to axis X. Angle C may be in a range of about 55 to about 65 degrees. When brake 14 is used with gun tube 10 having a 105 mm caliber, angle C may be about 60 degrees.

Forward-angled front surface 46 of vane 30 may have an angle D with respect to axis X. Angle D may be in a range of about 62 to about 72 degrees. When brake 14 is used with gun tube 10 having a 105 mm caliber, angle D may be about 67 degrees.

Rearward-angled rear surface 48 of vane 32 may have an angle E with respect to axis X. Angle E may be in a range of about 59 to about 69 degrees. When brake 14 is used with gun tube 10 having a 105 mm caliber, angle A may be about 64 degrees.

Referring to FIG. 3, an outer diameter F of vane 28 may be greater than outer diameters G, H of vanes 30, 32, respectively. The larger diameter F of vane 28 may better shield the rear of the gun from the propellant gases. Outer diameters G, H of vanes 30, 32 may be equal, which may assist in controlling the gas expansion. When brake 14 is used with gun tube 10 having a 105 mm caliber, outer diameter F of vane 28 may be about 360 mm and outer diameters G, H of vanes 30, 32 may be about 340 mm.

Figure 7:
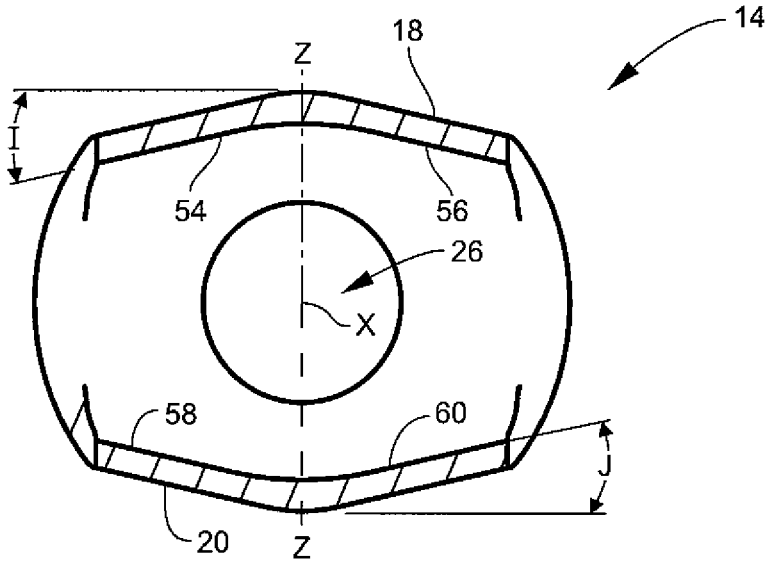
FIG. 7 is a sectional view of the brake taken along the line 7-7 of FIG. 4.

FIG. 7 is a sectional view of brake 14 taken along the line 7-7 of FIG. 4. Internal surfaces of top 18 and bottom 20 may be configured to control expulsion of the propellant gas from brake 14. Top 18 may include internal surfaces 54, 56 that may be substantially symmetric about a plane ZZ that substantially bisects brake 14 and contains axis X. Bottom 20 may include internal surfaces 58, 60 that may be substantially symmetric about plane ZZ. Surfaces 54, 56, 58, 60 may be planar surfaces. Surfaces 54, 56 of top 18 may be angled downward and may form an angle I with a plane normal to plane ZZ. Surfaces 58, 60 of bottom 20 may be angled upward and may form an angle J with a plane normal to plane ZZ. Angle I and angle J may have the same value. When brake 14 is used with gun tube 10 having a 105 mm caliber, angles I and J may be about 13 degrees.

Referring to FIG. 6, a radially innermost center point of vane 30 may be an axial distance K from a radially innermost point of forward-angled internal surface 42 of vane 28. A radially innermost point of rearward-angled rear surface 48 of vane 32 may be an axial distance L from radially innermost center point of vane 30. Distance K may be less than distance L. When distance K is less than distance L, the compressible gases exiting the first baffle may interfere more with the compressible gases exiting the second baffle, thereby allowing the second baffle to be more effective. When brake 14 is used with gun tube 10 having a 105 mm caliber, distance K may be about 170 mm and distance L may be about 200 mm.

Brake 14 may provide new results by reducing the BOP experienced by the crew of an indirect fire weapon. Brake 14 may reduce BOP while maintaining the critical recoil reduction. By reducing the BOP, the peak decibel levels may be reduced thereby allowing the crew to fire more rounds in a single day under both single and double ear protection. The ability to fire more rounds may make the indirect fire weapon more lethal to its targets.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A muzzle brake for attachment to a muzzle of a gun tube, comprising:

a body having a top, a bottom, and vanes that extend from the top to the bottom;

an attachment hub at a rear end of the body;

a longitudinal bore through the body and the hub, the bore being centered on a longitudinal axis;

a first of the vanes being located at a front of the bore in the attachment hub, the first vane having a forward-angled internal surface;

a second of the vanes being located axially forward of the first vane, the second vane having a forward-angled rear surface and a forward-angled front surface; and a third of the vanes being located axially forward of the second vane, the third vane having a rearward-angled rear surface.

2. The brake of claim 1, wherein a number of vanes is no more than three.

3. The brake of claim 1, wherein the forward-angled internal surface of the first vane includes an inner surface adjacent the bore and an outer surface adjacent the inner surface, the inner and outer surfaces being angled differently with respect to the longitudinal axis.

4. The brake of claim 3, wherein the inner surface has a greater angle with respect to the longitudinal axis than the outer surface.

5. The brake of claim 4, wherein an angle between the inner surface and the longitudinal axis is in a range of about 65 to about 75 degrees and an angle between the outer surface and the longitudinal axis is in a range of about 40 to about 45 degrees.

6. The brake of claim 4, wherein the rear surface of the second vane has an angle of about 55 to about 65 degrees with respect to the longitudinal axis.

7. The brake of claim 6, wherein the front surface of the second vane has an angle of about 62 to about 72 degrees with respect to the longitudinal axis.

8. The brake of claim 4, wherein the rear surface of the third vane has an angle of about 59 to about 69 degrees with respect to the longitudinal axis.

9. The brake of claim 4, wherein an outer diameter of the first vane is greater than outer diameters of the second and third vanes.

10. The brake of claim 9, wherein the outer diameters of the second and the third vanes are substantially the same.

11. The brake of claim 9, wherein an internal surface of the top includes a pair of planar surfaces arranged substantially symmetric to a plane that substantially bisects the brake and includes the longitudinal axis.

12. The brake of claim 11, wherein an internal surface of the bottom includes a pair of planar surfaces arranged substantially symmetric to the bisecting plane.

13. The brake of claim 12, wherein the pairs of planar surfaces of the top and bottom are angled towards each other.

14. The brake of claim 13, wherein angles formed by the pairs of the planar surfaces with a plane normal to the bisecting plane are substantially equal.

15. The brake of claim 4, wherein an axial distance from a radially innermost point of the forward-angled internal surface of the first vane to a radially innermost center point of the second vane is less than an axial distance from the radially innermost center point of the second vane to a radially innermost point of the rearward-angled rear surface of the third vane.

* * * * *